US005398420A

United States Patent [19]

Kleinschmidt

[11] Patent Number: 5,398,420

[45] Date of Patent: Mar. 21, 1995

[54] ARCHERY BOW SIGHT

[76] Inventor: Jerry C. Kleinschmidt, HC 31 Box 981, Happy Jack, Ariz. 86024

[21] Appl. No.: 92,951

[22] Filed: Jul. 19, 1993

[51] Int. Cl.[6] ..... F41G 1/467

[52] U.S. Cl. ..... 33/265; 124/87

[58] Field of Search ..... 33/265, 245, 250; 124/87

[56] References Cited

U.S. PATENT DOCUMENTS

| | | | |
|---|---|---|---|
| 3,410,644 | 11/1968 | McLendon | 33/265 |
| 4,417,403 | 11/1983 | Strange | 33/265 |
| 4,494,313 | 1/1985 | Scott | 33/265 |
| 4,542,591 | 9/1985 | Montgomery | 33/265 |
| 4,580,349 | 4/1986 | Webb et al. | 33/265 |
| 4,584,777 | 4/1986 | Saunders | 33/265 |
| 4,616,422 | 10/1986 | Gaddy | 33/265 |
| 4,662,347 | 5/1987 | Carlton | 33/265 |
| 4,915,088 | 4/1990 | Powers | 33/265 |
| 4,953,302 | 9/1990 | Gould | 33/265 |
| 5,048,193 | 9/1991 | Hacquet | 33/265 |

*Primary Examiner*—Thomas B. Will

[57] ABSTRACT

An archery bow sight apparatus has a single front, horizontally adjustable, target sight pin and a plurality of rear, horizontally and vertically adjustable, yardage sight pins, each of the mar pins designated for a different, specific shooting distance. The sight apparatus is initially adjusted (or sighted in) by first pulling the bow string back until it touches the archer's cheek, at which point the single front pin is slid horizontally in or out to the point where it is centered on the target. The front pin is then locked into this position. The rear yardage sight pins are each individually adjusted for a different specific distance by selecting a target a specific distance away and aligning the first of the rear distance pins with the front target pin. Shooting accuracy is then increased by adjusting the position of the first rear pin to the right or left (horizontally) and up or down (vertically) by shooting arrows and then slightly sliding the rear pin appropriately based on where the arrows hit. The other two rear pins are adjusted similarly for other specific distances.

4 Claims, 4 Drawing Sheets

FIG. 3
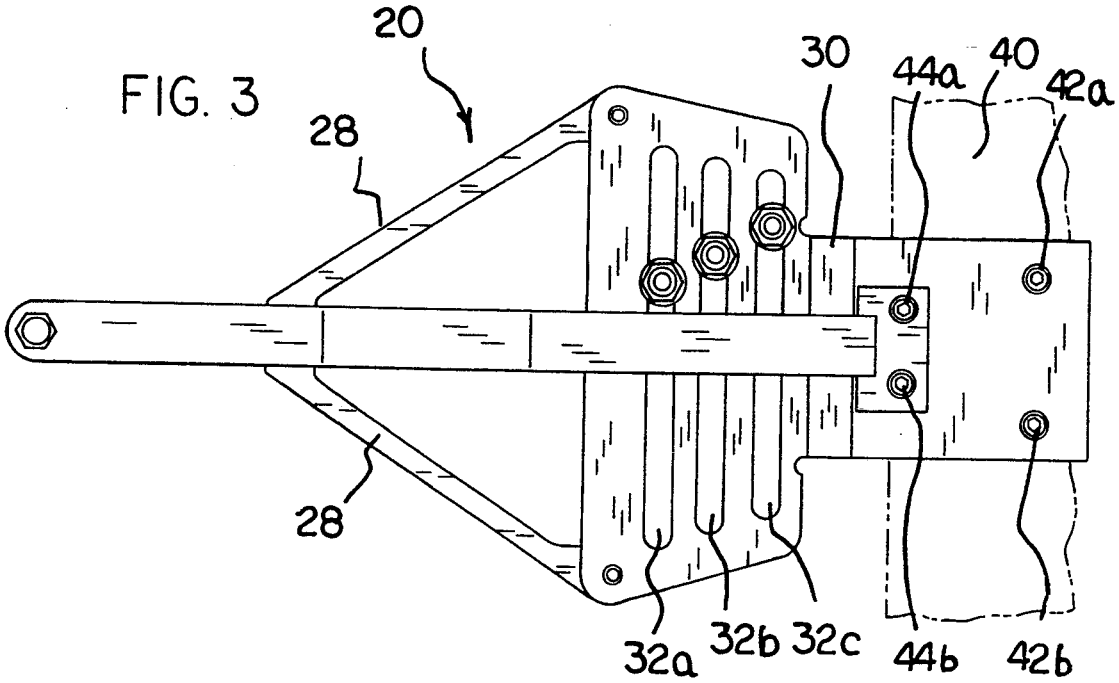
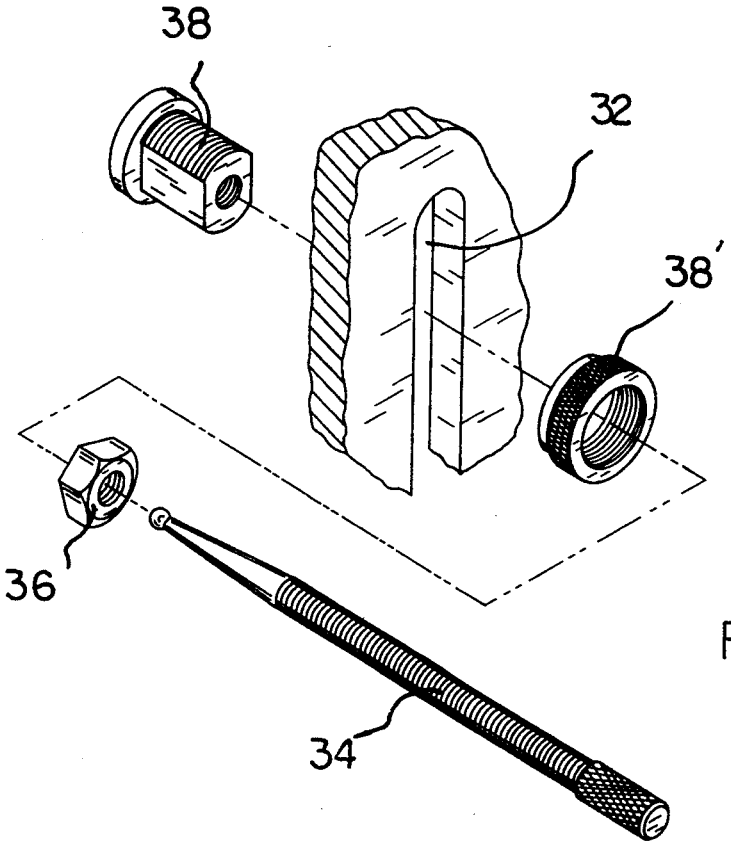
FIG. 4

ARCHERY BOW SIGHT

BACKGROUND OF THE INVENTION

1. Field of the Invention

The present invention relates generally to archery devices, and more particularly, to an archery bow sight specially adapted to provide improved arrow shooting accuracy.

2. Description of the Prior Art

Bow sights in the form of a single point to sight on are well known in the art of archery. Attempts to provide more than one sight point have been made (see for example the following U.S. Pat. Nos.: 3,488,853; 4,494,313; and 5,048,193).

Thus, while the foregoing body of prior art indicates it to be known to use archery sights, and that several attempts have made to use more than one sight point, the provision of a more simple and cost effective device is not contemplated. Nor does the prior art described above teach or suggest an adjustable archery bow sight which may be used by archers to sight their arrow shot using a single front and a plurality of rear adjustable sight pins for accuracy at several specific distances (the number of specific distances being the number of rear sight pins). The foregoing disadvantages are overcome by the unique archery bow sight of the present invention as will be made apparent from the following description thereof. Other advantages of the present invention over the prior art also will be rendered evident.

SUMMARY OF THE INVENTION

To achieve the foregoing and other advantages, the present invention, briefly described, provides an archery bow sight apparatus having a single front, horizontally adjustable, target sight pin and a plurality of rear, horizontally and vertically adjustable, yardage sight pins, each of the rear pins designated for a different, specific shooting distance. The sight apparatus is initially adjusted (or sighted in) by first pulling the bow string back until it touches the archer's cheek, at which point the single front pin is slid horizontally in or out to the point where it is centered on the target. The front pin is then locked into this position. The rear yardage sight pins are each individually adjusted for a different specific distance by selecting a target a specific distance away and aligning the first of the rear distance pins with the front target pin. Shooting accuracy is then increased by adjusting the position of the first rear pin to the right or left (horizontally) and up or down (vertically) by shooting arrows and then slightly sliding the rear pin appropriately based on where the arrows hit. The other two rear pins are adjusted similarly for other specific distances.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new archery bow sight which has all of the advantages of the prior art and none of the disadvantages.

It is another object of the present invention to provide a new archery bow sight which may be easily and efficiently manufactured and marketed.

It is a further objective of the present invention to provide a new archery bow sight which is of durable and reliable construction.

An even further object of the present invention is to provide a new archery bow sight which is susceptible of a low cost of manufacture with regard to both materials and labor, and which accordingly is then susceptible of low prices of sale to the consuming public, thereby making such archery bow sight available to the buying public.

Still yet a further object of the present invention is to provide a new archery bow sight which can be used by virtually anybody to quickly and easily increase their archery accuracy.

It is still a further object of the present invention is to provide a new archery bow sight having a single adjustable front sight pin and a plurality of rear adjustable sight pins, each of the rear pins designated for a different specific shooting distance.

Still a further object of the present invention is to provide a new archery bow sight including means for adjusting the rear sight pins horizontally and vertically to fine tune the precision of the sight device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a side view of the archery bow sight of FIGS. 1 and 2 in accordance with the present invention.

FIG. 4 is a perspective view in elevation of separated parts of the archery bow sight of the present invention.

DESCRIPTION OF THE PREFERRED EMBODIMENT

With reference now to the drawings, a new archery bow sight embodying the principles and concepts of the present invention will be described.

Figure 1:
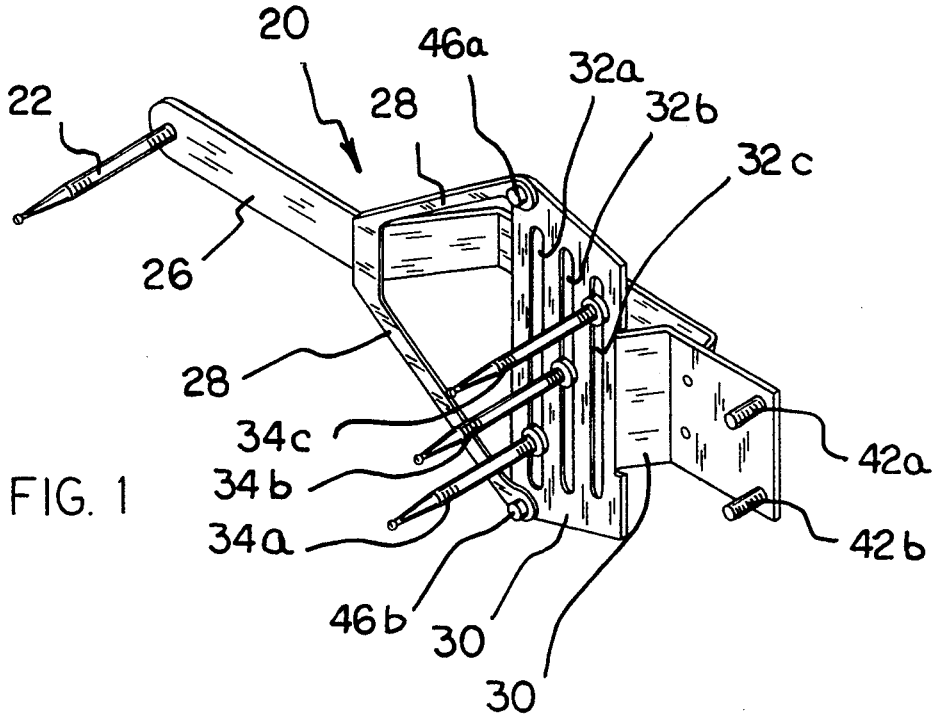
FIG. 1 is a perspective view from above showing the first preferred embodiment of the archery bow sight of the present invention.
Figure 2:
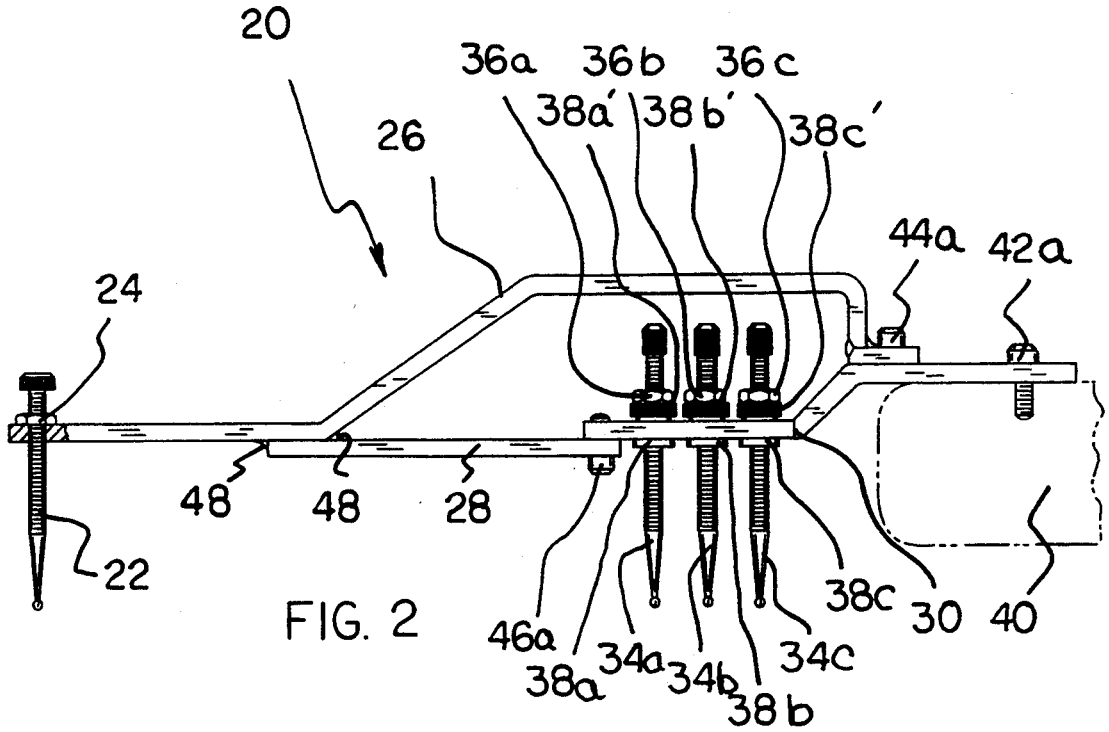
FIG. 2 is a top view of the archery bow sight of FIG. 1 mounted on a bow in accordance with the present invention.

Turning initially to FIGS. 1–3, there is shown a first exemplary embodiment of the archery bow sight of the invention generally designated by reference numeral 20. In its preferred form, archery bow sight 20 comprises generally a framework for holding sight pins. The framework is preferably comprised of three, preferably metal, frame pieces: a front frame piece 26, a C-shaped brace piece 28, and a back frame piece 30. The three frame pieces are held together by threaded screws which run through threaded holes in each of the three frame pieces and by welding. Front frame piece 26 is held to back frame piece 30 by screws 44*a* and 44*b*. Front frame piece 26 is held to C-shaped brace 28 by welding joint 48. C-shaped brace 28 is held to back frame piece 30 by screws 46*a* and 46*b*.

Front frame piece 26 has a threaded hole drilled near its front for holding a horizontally adjustable (by screwing and unscrewing) threaded front target sight pin 22 which can be held in position by a hex lock nut 24.

Back frame piece 30 has three slots 32*a*, 32*b*, and 32*c* adapted to hold three yardage pins 34*a*, 34*b*, and 34*c* respectively. The three yardage pins 34*a*, 34*b* and 34*c* are horizontally adjustable (right and left) and also vertically adjustable (up and down).

Figure 5:
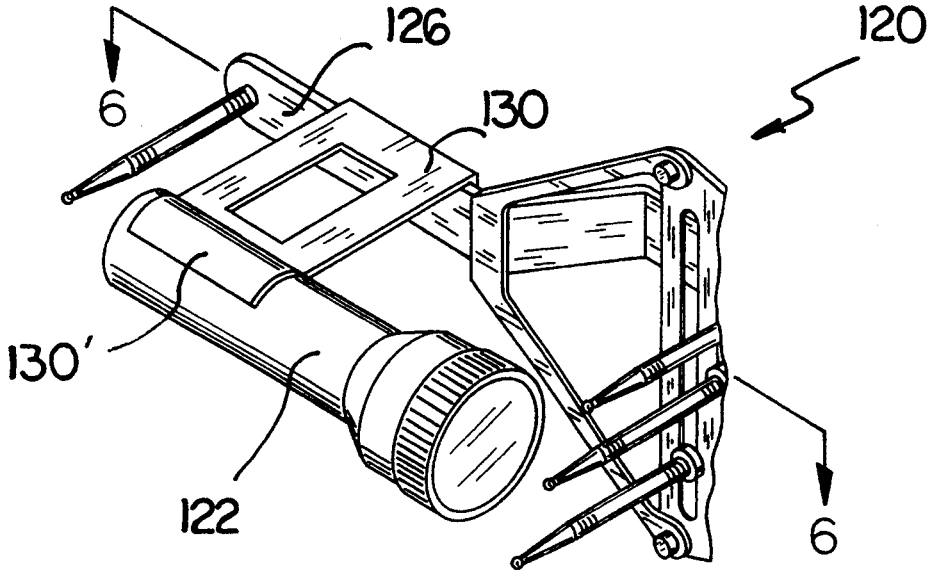
FIG. 5 is a partial perspective view in elevation of a second preferred embodiment of the present invention.
Figure 6:
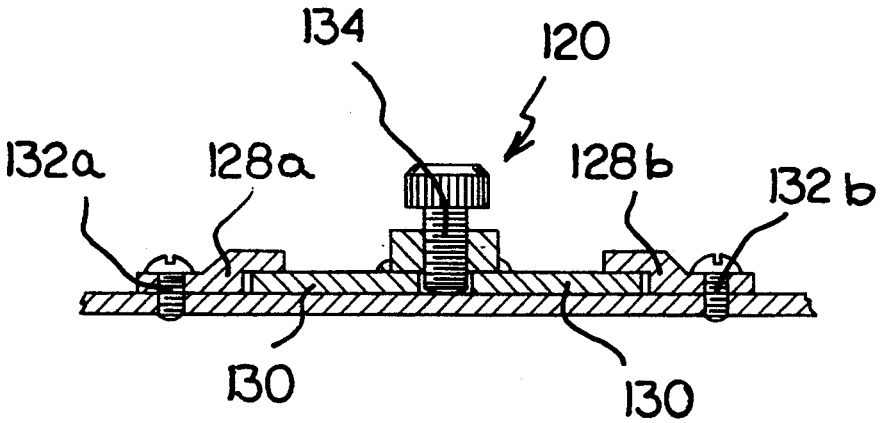
FIG. 6 is a cross-sectional top view of a section of the second preferred embodiment of the present invention taken along 6—6 of FIG. 5.

FIGS. 4 and 5 shows a yardage pin 34 in more detail. The yardage pin 34 is slidable up and down within slot 32. The pin 34 fits through a threaded up and down adjuster 38 (there are three adjusters 38*a*, 38*b*, and 38*c* used in the preferred embodiment) and a corresponding locknut 38' (locknuts 38'*a*, 38'*b*, 38'*c* in the preferred embodiment).

The pins 34 are also horizontally adjustable as they can be screwed through a locknut 36 (locknuts 36*a*, 36*b* and 36*c* in the preferred embodiment).

The back frame piece 30 includes an unlabeled mounting bracket projecting from a rear edge thereof. The sight apparatus 20 can be mounted to a bow 40 by means of screws 42*a*, 42*b* which extend through the mounting bracket to secure the device 20 to the bow 40.

Use of the sight apparatus 20 once it is mounted on the bow 40 is very easy. First the front pin 22 and the rear pins 34*a*, 34*b*, and 34*c* are preliminarily positioned (screwed into a temporary position). The sight apparatus 20 is initially adjusted (or sighted in) by first pulling the bow string back until it touches the archer's cheek, at which point the single front pin 22 is slid horizontally in or out to the point where it is centered on the target. The front pin 22 is then locked into this position. The rear yardage sight pins 34*a*, 34*b*, and 34*c* are each individually adjusted for a different specific distance by selecting a target a specific distance away and aligning the first of the rear distance pins 34*a*, 34*b* and 34*c* with the front target pin 22. Shooting accuracy is then increased by adjusting the position of the first rear pin 34*a* to the right or left (horizontally) and up or down (vertically) by shooting arrows and then slightly sliding the rear pin 34*a* (for vertical adjustments and turning the pin 34*a* for horizontal adjustments) appropriately based on where the arrows hit. The other two rear pins 34*b* and 34*c* are adjusted similarly for other specific distances. Once the sight apparatus 20 is adjusted it should remain properly adjusted, although slight tuning up of the pin adjustments will be simple if necessary and changes to take wind conditions into account will also be simple by adjusting the rear pins accordingly. If a second archer wishes to use the bow 40 with the sight apparatus 20, it will be necessary to retune the pin adjustments. This will be quickly and easily accomplished by following the same steps as were done in the initial pin adjustments.

A second embodiment archery bow sight 120 in accordance with the present invention is shown ion FIG. 5. The bow sight 120 apparatus is similar to the first embodiment with the addition of an optical sight device 122 for making it easier to focus in on far away targets or for archers with poorer eyesight. The second embodiment apparatus 120 has a modified front piece 126 adapted to hold the optical sight 122 and mount pieces 128*a*, 128*b* for holding and supporting optical sight mount 130 using screws 132*a*, 132*b*. The optical sight 122 is held in position on the sight mount 130 by means of metal snap in piece 130'. A fine tuning knob 134 can be used properly position the optical sight 122 in the archer's line of eyesight.

Figure 7:
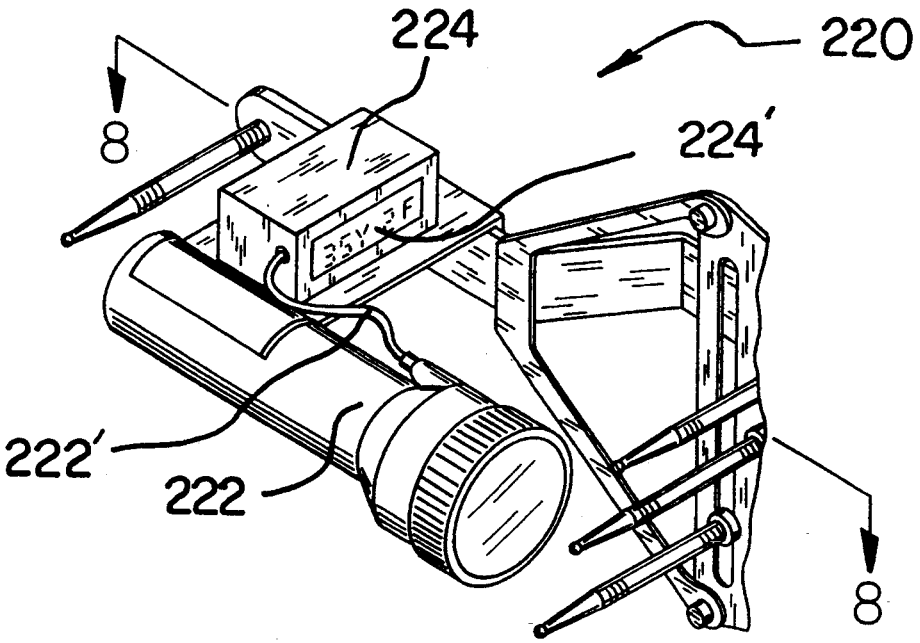
FIG. 7 is a partial perspective view in elevation of a third preferred embodiment of the present invention.
Figure 8:
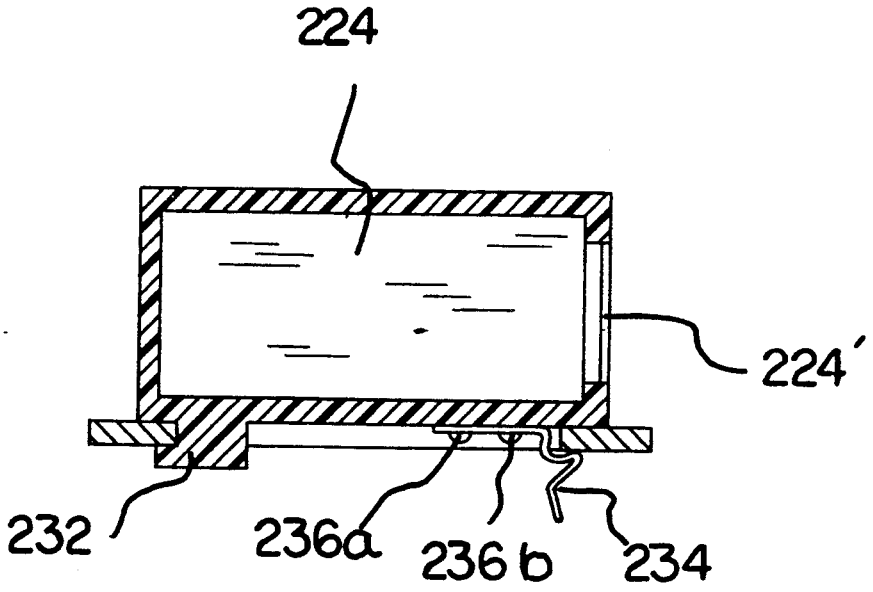
FIG. 8 is a cross-sectional side view of a section of the third preferred embodiment of the present invention taken along 8—8 of FIG. 7.

A third embodiment archery bow sight 220 having an optical sight device 222 is shown in FIGS. 7 and 8. The third embodiment is similar to the second embodiment with the addition of digital range meter 224 connected to the optical sight by means of wire 222'. The digital range meter 224 has a display face 224'. The range meter 224 can be mounted by means of integral catch piece 232 and piece 234 secured using mount screws 236*a*, 236*b*.

Use of the third embodiment is the same as the second embodiment with the addition of the digital range meter providing the archer with the distance to the target.

Use of an archery bow sight constructed in accordance with the present invention will provide two points to sight from for several different fixed distances (three fixed distances in the preferred embodiments). The invention can be used on either a right hand or left hand compound bow, as well as a recurve bow. The mounting holes for the invention are preferably standard for bows and the invention will not interfere with the mounting quiver. Once sighted in, the invention should remain on the mark indefinitely.

It is apparent from the above that the present invention accomplishes all of the objectives set forth by providing a new archery bow sight which can be mounted on a bow comprised of: a single front, horizontally adjustable, target sight pin; a plurality of rear, horizontally and vertically adjustable, yardage sight pins, each of the rear pins designated for a different, specific shooting distance; and a support means for supporting the single front pin and the plurality of rear pins. The pins can be temporarily locked into position. The invention can further be comprised of an optical sighting means. The invention can further be comprised of a range metering means. The plurality of rear pins can be and is preferably three rear pins.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. An archery bow sight for use with a bow, said bow having a front surface and a rear surface with said front surface facing towards a target and said rear surface facing towards both a string of said bow and a user holding said bow during a shooting of said bow, said archery bow sight comprising:

a back frame piece, said back frame piece comprising a substantially planar member having a back frame top edge, a back frame bottom edge, a back frame front edge, and a back frame rear edge with at least two parallel slots extending from proximal said back frame top edge to proximal said back frame bottom edge, said back frame further comprising a mounting bracket projecting from said back frame rear edge, said mounting bracket having a pair of through-extending mounting apertures such that said mounting bracket can be secured to a portion of said bow such that said back frame piece is positioned forwardly of said front surface of said bow between said front surface of said bow and said target;

a first yardage pin movably mounted to said back frame piece within a first one of said slots;

a second yardage pin movably mounted to said back frame piece within a second one of said slots;

a front frame piece coupled to said back frame piece and extending from said back frame to beyond said back frame front edge, said front frame piece terminating in an outer distal end positioned forwardly of both said front surface of said bow and said back frame front edge such that said front frame piece outer distal end is positioned between said back frame front edge and said target;

and, a target sight pin mounted to said distal end of said front frame piece, wherein a pivoting of said bow within a vertical plane and about a horizontal axis directed parallelly between said front and rear surfaces of said bow will pivot both said yardage pins and said target sight pin in a single predetermined vertical direction within said vertical plane, said target pin being selectively alignable with both a target and an individual one of said yardage pins during shooting of said bow.

2. The archery bow sight of claim 1, and further comprising a C-shaped brace piece having a center portion and a pair of brace distal ends, said center portion of said C-shaped brace piece being fixedly secured to said front frame piece, and said brace distal ends each being secured to a portion of said back frame piece proximal to said back frame front edge.

3. The archery bow sight of claim 2, and further comprising a sight mount extending orthogonal to said front frame piece and extending between said front frame piece and said back frame piece; and an optical sight device mounted to said sight mount and positioned between said target sight pin and said yardage pins.

4. The archery bow sight of claim 3, and further comprising a digital range meter mounted on top of said sight mount and between said optical sight device and said front frame piece, said digital range meter including a display face positioned towards said yardage pins such that said display face can be read by said user during shooting of said bow.

* * * * *